US007066801B2

(12) United States Patent
Balijepalli et al.

(10) Patent No.: US 7,066,801 B2
(45) Date of Patent: Jun. 27, 2006

(54) METHOD OF MANUFACTURING A FIXED ABRASIVE MATERIAL

(75) Inventors: Sudhakar Balijepalli, Midland, MI (US); Dale J. Aldrich, Lake Jackson, TX (US); Laura A. Grier, Brazoria, TX (US); Bedri Erdem, Pearland, TX (US); Gregory F. Meyers, Midland, MI (US)

(73) Assignee: Dow Global Technologies, Inc., Midland, MI (US)

( * ) Notice: Subject to any disclaimer, the term of this patent is extended or adjusted under 35 U.S.C. 154(b) by 346 days.

(21) Appl. No.: 10/369,628

(22) Filed: Feb. 21, 2003

(65) Prior Publication Data

US 2004/0166790 A1 Aug. 26, 2004

(51) Int. Cl.
*B24D 11/00* (2006.01)

(52) U.S. Cl. ..... 451/526; 451/41; 451/529; 483/691

(58) Field of Classification Search ..... 451/526, 451/41, 529; 483/691, 693
See application file for complete search history.

(56) References Cited

U.S. PATENT DOCUMENTS

| | | | | |
|---|---|---|---|---|
| 4,092,286 A | | 5/1978 | Noll et al. | 260/29.2 |
| 4,142,663 A | * | 3/1979 | Blatnik et al. | 228/147 |
| 4,237,264 A | | 12/1980 | Noll et al. | 528/67 |
| 5,197,999 A | | 3/1993 | Thomas | 51/298 |
| 5,287,663 A | | 2/1994 | Pierce et al. | 51/401 |
| 5,421,769 A | | 6/1995 | Schultz et al. | 451/287 |
| 5,441,598 A | | 8/1995 | Yu et al. | 156/645.1 |

(Continued)

FOREIGN PATENT DOCUMENTS

| | | |
|---|---|---|
| WO | WO 98/18159 | 4/1998 |
| WO | WO 00/24842 | 5/2000 |
| WO | 01/74535 A1 | 10/2001 |
| WO | WO 02/22309 A1 | 3/2002 |

OTHER PUBLICATIONS

Ho–youn Kim et al., "Development of an Abrasive Embedded Pad for Dishing Reduction and Uniformity Enhancement", Journal of the Korean Physical Society, vol. 37, No. 6, Dec. 2000, pp 945–951.

Alexander Simpson et al., "Fixed Abrasive Technology for STI CMP on a Web Format Tool", Mat. Res. Soc. Symp. Proc. vol. 671 (2001) Materials Research Society, pp 1–9.

Dipto G. Thakurta et al., "Pad porosity, compressibility and slurry delivery effects in chemical–mechanical planarization modeling and experiments", Thin Solid Films 366 (2000) pp 181–190.

B.J. Hooper et al., "Pad conditioning in chemical mechanical polishing", Journal of Materials Processing Technology 123 (2002) pp 107–113.

P. van der Velden, "Chemical mechanical polishing with fixed abrasives using different subpads to optimize wafer uniformity", Microelectronic Engineering 50 (2000) pp 41–46.

*Primary Examiner*—Joseph J. Hail, III
*Assistant Examiner*—Alvin J Grant
(74) *Attorney, Agent, or Firm*—Harness, Dickey & Pierce, P.L.C.

(57) ABSTRACT

Provided is a method for manufacturing a fixed abrasive material suitable for use in CMP planarization pads from an aqueous polymer dispersion that also includes abrasive particles that involves frothing the polymer dispersion, applying the froth to a substrate, mold or carrier and curing the froth to form a fixed abrasive material having an open cell structure containing between about 5 and 85 wt % abrasive particles and a dry density of about 350 kg/m$^3$ to 1200 kg/m$^3$.

26 Claims, 6 Drawing Sheets

U.S. PATENT DOCUMENTS 5,510,652 A 4/1996 Burke et al. ..... 257/752
5,516,729 A 5/1996 Dawson et al. ..... 437/228
5,624,303 A 4/1997 Robinson ..... 451/285
5,692,950 A 12/1997 Rutherford et al. ..... 451/552
6,069,080 A * 5/2000 James et al. ..... 438/691
6,095,902 A 8/2000 Reinhardt ..... 451/36
6,099,393 A 8/2000 Katagiri et al. ..... 451/56
6,099,394 A 8/2000 James et al. ..... 451/72
6,099,954 A 8/2000 Urbanavage et al. .... 428/314.2
6,271,276 B1 8/2001 Gribble et al. ..... 521/133
6,302,770 B1 10/2001 Aiyer ..... 451/56
6,326,340 B1 * 12/2001 Labib et al. ..... 510/161
6,337,281 B1 * 1/2002 James et al. ..... 51/294
6,364,749 B1 4/2002 Walker ..... 451/41
6,368,200 B1 4/2002 Merchant et al. ..... 451/527
6,387,807 B1 5/2002 Faubert et al. ..... 438/687
6,390,895 B1 5/2002 Katagiri et al. ..... 451/56
6,416,685 B1 7/2002 Zhang et al. ..... 252/79.1
6,431,960 B1 8/2002 Walker et al. ..... 451/41
6,435,947 B1 * 8/2002 Mueller et al. ..... 451/41
6,436,835 B1 8/2002 Kido et al. ..... 438/693
6,454,634 B1 9/2002 James et al. ..... 451/41
6,458,023 B1 10/2002 Moon ..... 451/526
6,468,911 B1 10/2002 Miyashita et al. ..... 438/692
6,475,069 B1 11/2002 Thomas et al. ..... 451/57
6,477,825 B1 11/2002 Katagiri et al. ..... 56/451
6,478,659 B1 11/2002 Peng et al. ..... 451/8
6,485,356 B1 11/2002 Sabde et al. ..... 451/41
6,514,301 B1 * 2/2003 Lombardo ..... 51/295
6,524,961 B1 2/2003 Katagiri et al. ..... 438/691
6,537,137 B1 3/2003 Oliver ..... 451/41
6,767,488 B1 * 7/2004 Shaw et al. ..... 264/45.3
2001/0053660 A1 12/2001 Koinkar et al. ..... 451/56
2002/0004357 A1 1/2002 Baker, III et al. ..... 451/41
2002/0072307 A1 6/2002 Fruitman et al. ..... 451/36
2002/0076931 A1 6/2002 Plat et al. ..... 438/689
2002/0098701 A1 7/2002 Hasegawa ..... 438/692

* cited by examiner

METHOD OF MANUFACTURING A FIXED ABRASIVE MATERIAL

TECHNICAL FIELD

The present invention relates generally to fixed abrasive materials and, in particular, the manufacture of fixed abrasive materials suitable for use in planarizing pads for removing process material layers from the surface of semiconductor substrates.

BACKGROUND

Ultra large scale integrated (ULSI) semiconductor devices, such as dynamic random access memories (DRAMs) and synchronous dynamic random access memories (SDRAMs), consist of multiple layers of conducting, semiconducting, and insulating materials, interconnected within and between layers in specific patterns designed to produce desired electronic functionalities. The materials are selectively patterned on each layer of the device, using lithographic techniques, involving masking and etching the materials. This is a very precise process, particularly as the size of the device structures continues to decrease and the complexity of the circuits continues to increase. Height differences, pitch and reflectivity variations and other imperfections present in the surface of underlying layers may compromise the formation of additional process layers and/or the ability to precisely position and dimension photoresist patterns formed during subsequent lithography processes.

A variety of methods have been developed in the art so as to increase the planarity of the layers during the manufacturing process. Such methods include reflow processes with deposited oxides, spin-on-glass (SOG) processes, etchback processes and Chemical-Mechanical Planarization (CMP) processes (also referred to as Chemical-Mechanical Polishing). CMP processes have been developed for removing a wide variety of materials including oxides, nitrides, suicides and metals from the surface of a semiconductor substrate. As used herein, the terms planarization and polishing are intended to be mutually inclusive terms for the same general category of processes.

A variety of different machine configurations have been developed for performing the various CMP processes. Machines used for CMP processing can be broadly grouped into either web-feed or fixed-pad categories. In both categories, however, the basic process uses a combination of a planarizing pad and a planarizing liquid to remove material from the surface of a semiconductor substrate using primarily mechanical action or through a combination of chemical and mechanical action.

The planarizing pads, in turn, can be broadly grouped into fixed-abrasive (FA) or non-abrasive (NA) categories. In fixed-abrasive pads, abrasive particles are distributed in material that forms at least a portion of the planarizing surface of the pad, while non-abrasive pad compositions do not include any abrasive particles. Because the fixed-abrasive pads already include abrasive particles, they are typically used in combination with a "clean" planarizing liquid that does not add additional abrasive particles. With non-abrasive pads, however, substantially all of the abrasive particles used in the planarizing process are introduced as a component of the planarizing liquid, typically as a slurry applied to the planarizing surface of the pad. Both the "clean" and abrasive planarizing liquids can also include other chemical components, such as oxidizers, surfactants, viscosity modifiers, acids and/or bases in order to achieve the desired liquid properties for the removal of the targeted material layer from the semiconductor substrate and/or to provide lubrication for decreasing defectivity rates.

CMP processes typically utilize a combination of mechanical abrasion and chemical reaction(s) provided by the action of the planarizing slurry or planarizing liquid and a planarizing pad in order to remove one or more materials from a wafer surface and produce a substantially planar wafer surface. Planarizing slurries used in combination with non-abrasive pads, particularly for the removal of oxide layers, generally comprise a basic aqueous solution of a hydroxide, such as KOH, containing abrasive silica particles. Planarizing slurries, particularly for the removal of metal layers such as copper, generally comprise an aqueous solution of one or more oxidizers, such as hydrogen peroxide, to form the corresponding metal oxide that is then removed from the substrate surface.

The planarizing pads used in such processes typically comprise porous or fibrous materials, such as polyurethanes, that provide a relatively compliant surface onto which the planarizing slurry may be dispensed. The consistency of a CMP process may be greatly improved by automating the process so that the planarizing is terminated in response to a consistently measurable endpoint reflecting sufficient removal of an overlying material layer, typically followed by a brief "overetch" or "over-polish" to compensate for variations in the thickness of the material layer.

The size and concentration of the particles for planarizing a wafer surface can directly affect the resulting surface finish and the productivity of a CMP process. For example, if the abrasive particulate concentration is too low or the abrasive particle size too small, the material removal rate will generally slow and process throughput will be reduced. Conversely, if the abrasive particulate concentration is too high, the abrasive particles are too large or the abrasive particles begin to agglomerate, the wafer surface is more likely to be damaged, the CMP process may tend to become more variable and/or the material removal rate may decrease, resulting in reduced throughput, reduced yields or device reliability and/or increased scrap.

CMP processes may experience significant performance variations over time that further complicate processing of the wafers and reduce process throughput. In many cases, the performance variations may be attributable to changes in the characteristics of the planarizing pad as a result of the CMP process itself. Such changes may result from particulates agglomerating and/or becoming lodged in or hardening on the pad surface. Such changes may also be the result of wear, glazing or deformation of the pad, or simply the degradation of the pad material over time.

In a typical planarizing process, the planarizing machine brings the non-planar surface of a material layer formed over one or more patterns on a semiconductor substrate into contact with a planarizing surface of the planarizing pad. During the planarizing process, the surface of the planarizing pad will typically be continuously wetted with an abrasive slurry and/or a planarizing liquid to produce the desired planarizing surface. The substrate and/or the planarizing surface of the pad are then urged into contact and moved relative to one another to cause the planarizing surface to begin removing an upper portion of the material layer. This relative motion can be simple or complex and may include one or more lateral, rotational, revolving or orbital movements by the planarizing pad and/or the substrate in order to produce generally uniform removal of the material layer across the surface of the substrate.

As used herein, lateral movement is movement in a single direction, rotational movement is rotation about an axis through the center point of the rotating object, revolving movement is rotation of the revolving object about a non-centered axis and orbital movement is rotational or revolving movement combined with an oscillation. Although, as noted above, the relative motion of the substrate and the planarizing pad may incorporate different types of movement, the motion must typically be confined to a plane substantially parallel to the surface of substrate in order to achieve a planarized substrate surface.

Fixed abrasive pad types are known in the art of semiconductor wafer processing and have been disclosed in, for example, U.S. Pat. No. 5,692,950 to Rutherford et al.; U.S. Pat. No. 5,624,303 to Robinson; and U.S. Pat. No. 5,335,453 to Baldy et al. These types of fixed abrasive pads typically require a pre-conditioning cycle before they may be used in a CMP process, as well as periodic re-conditioning or in-situ surface conditioning during use, to generate a suitable number of asperities on the planarizing surface to maintain their planarizing ability.

The primary goal of CMP processing is to produce a defect-free planarized substrate surface having a material layer, or portions of a material layer, of uniform depth across the entire surface of the planarized substrate. Other goals, such as maximizing the throughput of the CMP process and reducing the per wafer cost, may, at times, conflict with the production of the best possible planarized surface. The uniformity of the planarized surfaces and the process throughput are directly related to the effectiveness and repeatability of the entire CMP process including the planarizing liquid, the planarizing pad, machine maintenance, as well as an array of other operating parameters. A variety of planarizing slurries and liquids have been developed that are somewhat specific to the composition of the material layer or layers that are to be removed and/or the composition of the planarizing pad being used. These tailored slurries and liquids are intended to provide adequate material removal rates and selectivity for particular CMP processes.

The benefits of CMP may be somewhat offset by the variations inherent in such a combination process, such as imbalances that may exist or may develop between the chemical and mechanical material removal rates of different material layers exposed on a single semiconductor substrate. Further, both the abrasive particles and other chemicals used in a typical CMP process may be relatively expensive and are generally unsuitable for reuse or recycling. This problem is compounded by the need to supply excess materials to the surface of the planarization pad to ensure that sufficient material is available at every point of the wafer surface as it moves across the pad. It is therefore desirable to reduce the quantity of abrasives and other chemicals used in a CMP process in order to reduce costs associated with both purchasing and storing the materials prior to use and the concerns and expense relating to the disposal of the additional waste materials.

A number of efforts toward reducing the variability and increasing the quality of CMP processes have been previously disclosed. For instance, U.S. Pat. No. 5,421,769 to Schultz et al. discloses a noncircular planarizing pad intended to compensate for variations resulting from the edges of a rotating wafer traveling across more of a planarizing pad than the interior surfaces. U.S. Pat. No. 5,441,598 to Yu et al. discloses a planarizing pad having a textured planarizing surface for providing a planarizing surface intended to provide more even polishing of wide and narrow structures across a wafer surface. U.S. Pat. No. 5,287,663 to Pierce et al. discloses a composite planarizing pad with a rigid layer opposite the planarizing surface and a resilient layer adjacent the rigid layer to reduce overplanarization, or "dishing," of material from between harder underlying features.

Other prior art efforts to minimize uneven planarization of wafers have focused on forming additional material layers on the wafer surface to act as "stop" layers to control overplanarization. U.S. Pat. Nos. 5,356,513 and 5,510,652 to Burke et al. and U.S. Pat. No. 5,516,729 to Dawson et al. all provide additional material layers having an increased resistance to the CMP process under the layer being removed to protect the underlying circuit structures. These additional material layers, however, both complicate the semiconductor manufacturing process flow and, as recognized by Dawson et al., do not completely overcome the problem of "dishing."

More recent efforts regarding planarizing pad compositions and constructions are disclosed in U.S. Pat. No. 6,425,815 B1 to Walker et al. (a dual material planarizing pad), U.S. Pat. No. 6,069,080 to James et al. (a fixed abrasive pad with a matrix material having specified properties), U.S. Pat. No. 6,454,634 B1 to James et al. (a multiphase self-dressing planarizing pad), WO 02/22309 A1 to Swisher et al. (a planarizing pad having particulate polymer in a cross-linked polymer binder), U.S. Pat. No. 6,368,200 B1 to Merchant et al. (a planarizing pad of a closed cell elastomer foam), U.S. Pat. No. 6,364,749 B1 to Walker (planarizing pad having polishing protrusions and hydrophilic recesses), U.S. Pat. No. 6,099,954 to Urbanavage et al. (elastomeric compositions with fine particulate matter) and U.S. Pat. No. 6,095,902 to Reinhardt (planarization pads manufactured from both polyester and polyether polyurethanes).

Each of the above references, in its entirety, is incorporated by reference in this disclosure.

BRIEF SUMMARY OF THE INVENTION

The present invention provides a method for manufacturing a fixed abrasive material having an open cell foam structure suitable for use in CMP planarization pads. The method comprises forming an aqueous polymer dispersion, typically comprising a polyurethane or polyurethane forming materials and abrasive particles, frothing the polymer dispersion to form a substantially homogeneous froth, applying the froth to a substrate, mold or carrier and curing the froth to form a fixed abrasive material having an open cell structure containing between about 5 and 85 wt % abrasive particles and a dry density of between about 350 $kg/m^3$ and 1200 $kg/m^3$ (about 21.8–75 $lbs/ft^3$).

The present invention provides a method for manufacturing fixed abrasive materials comprising:

- forming an aqueous dispersion, the aqueous dispersion including
  - at least one of a polymer or a polymer forming mixture, abrasive particles, and
  - a surfactant;
- injecting a frothing agent into the aqueous dispersion;
- mechanically frothing the aqueous dispersion and the frothing agent to form a substantially uniform froth;
- curing the uniform forth to form an open cell foam having interconnected cells and a polymer matrix wherein the abrasive particles are distributed substantially uniformly throughout the polymer matrix.

The present invention also provides a method for manufacturing fixed abrasive pads useful in the manufacture of semiconductor devices for planarizing one or more layers deposited or formed on a semiconductor substrate, comprising:

forming an aqueous dispersion, the aqueous dispersion including a polymer or a polymer forming mixture, abrasive particles, the abrasive particles having an average particle size of less than about 5 μm, and a surfactant;

injecting a frothing agent into the aqueous dispersion;

mechanically frothing the aqueous dispersion and the frothing agent to form a substantially uniform froth;

applying a layer of the froth to a substrate material;

curing the layer of the forth to form a layer of open cell foam comprising interconnected cells and a polymer matrix wherein the abrasive particles are distributed substantially uniformly throughout the polymer matrix.

Preferably, a planarizing or polishing pad according to the invention comprises a layer of the fixed abrasive material having an open cell foam structure containing between about 5 and 85 wt % abrasive particles and a dry bulk density of between about 350 kg/m$^3$ to 1200 kg/m$^3$ (about 21.8–75 lbs/ft$^3$) arranged on a suitable backing or substrate material.

It has been found that the methods of this invention afford benefits over methods among those known in the art, including improvements in one or more of improved ability to control the planarization process, increased uniformity of the planarized surface produced, reduced cost and increased throughput.

It should be noted that the graphs and illustrations of the Figures are intended to show the general characteristics of methods and materials of exemplary embodiments of this invention, for the purpose of the description of such embodiments herein. These graphs and illustrations may not precisely reflect the characteristics of any given embodiment, and are not necessarily intended to fully define or limit the range of values or properties of embodiments within the scope of this invention.

DETAILED DESCRIPTION OF THE INVENTION

Described below and illustrated in the accompanying drawings are certain exemplary embodiments according to the invention. These exemplary embodiments are described in sufficient detail to enable those of skill in the art to practice the invention, but are not to be construed as unduly limiting the scope of the following claims. Indeed, those of skill in the art will appreciate that other embodiments may be utilized and that process or mechanical changes may be made without departing from the spirit and scope of the inventions as described.

The present invention provides methods for producing fixed abrasive materials that may be useful in the production of semiconductor devices. As referred to herein, such semiconductor devices include any wafer, substrate or other structure comprising one or more layers comprising conducting, semiconducting, and insulating materials. The terms wafer and substrate are used herein in their broadest sense and include any base semiconductor structure such as metal-oxide-silicon (MOS), shallow-trench isolation (STI), silicon-on-sapphire (SOS), silicon-on-insulator (SOI), thin film transistor (TFT), doped and undoped semiconductors, epitaxial silicon, III–V semiconductor compositions, polysilicon, as well as other semiconductor structures at any stage during their manufacture. (As used herein, the word "include," and its variants, is intended to be non-limiting, such that recitation of items in a list is not to the exclusion of other similar, corresponding or equivalent items that may also be useful in the materials, compositions, devices, and methods of this invention.)

Figure 1A:
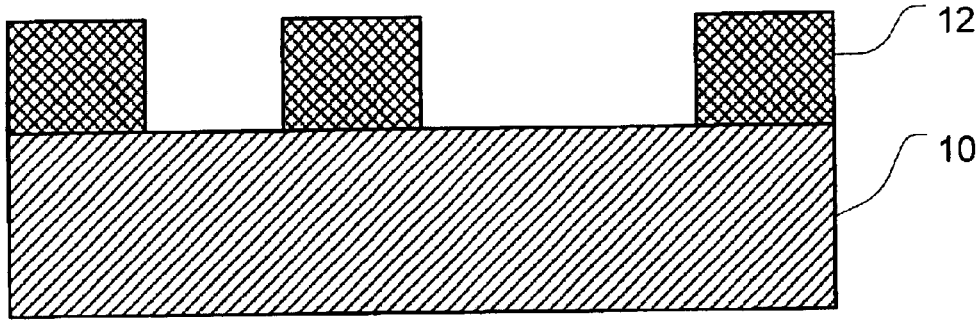
FIGS. 1A–C are cross-sectional views of a semiconductor substrate with a raised pattern, a material layer formed over the pattern, and the planarized substrate at sequential processing stages.
Figure 1B:
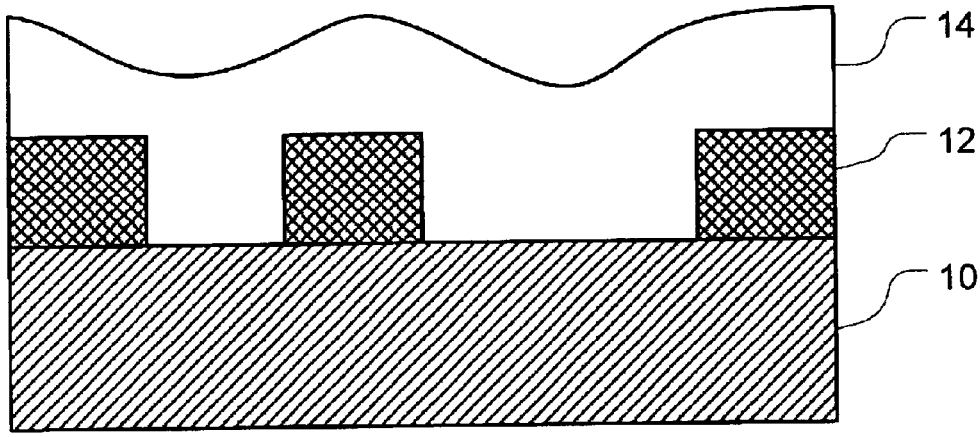

FIG. 1A illustrates a typical substrate 1 having a first layer 10 and a patterned second layer 12. In typical semiconductor processing, first layer 10 may comprise a wafer of single-crystal silicon or other base semiconductor layer, an insulating layer separating second patterned layer 12 from other layers, or a combination of multiple layers formed during previous processing steps. As illustrated in FIG. 1B, a material layer 14, which may actually comprise multiple layers of one or more materials, is then typically formed or deposited over the patterned layer 12, producing a non-planar surface on the wafer.

Figure 1C:
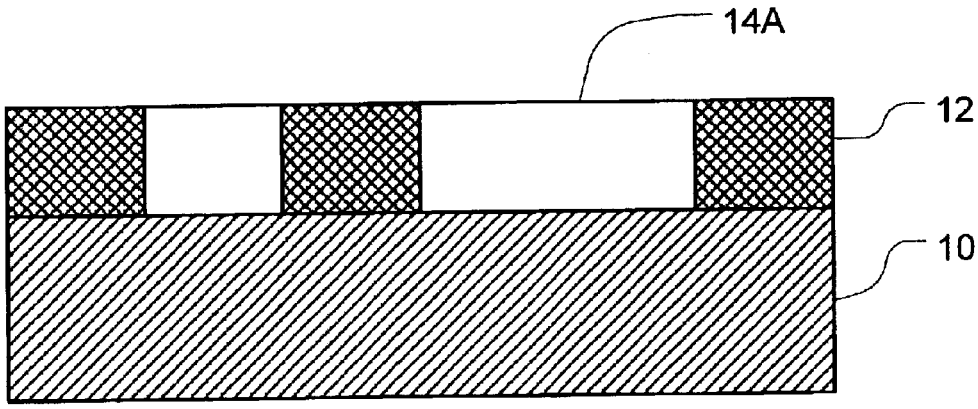

If allowed to remain, this lack of planarity would present significant, if not fatal, process complications during subsequent processing steps. As a result, most, if not all, semiconductor manufacturing processes include one or more planarization processes such as spin-on-glass (SOG), etchback (or blanket etch) or chemical-mechanical planarization (CMP) in order to form a substantially planar surface before the wafer is subjected to additional processing. A typical CMP process will remove that portion of material layer 14 that lies over the patterned layer 12 while leaving that portion 14A of the material layer 14 that was deposited in the openings of patterned layer 12 to produce a substantially more planar surface as illustrated in FIG. 1C. Depending on the process, a stop layer comprising a more CMP resistant material may be incorporated on the upper surface of the patterned layer 12 to protect the underlying pattern during the planarization process. The actual composition and structure of the first layer 10, second layer 12 and the material layer 14 may comprise any combination of semiconductor, insulator or conductor materials assembled during the manufacture of a semiconductor device.

Figure 2A:
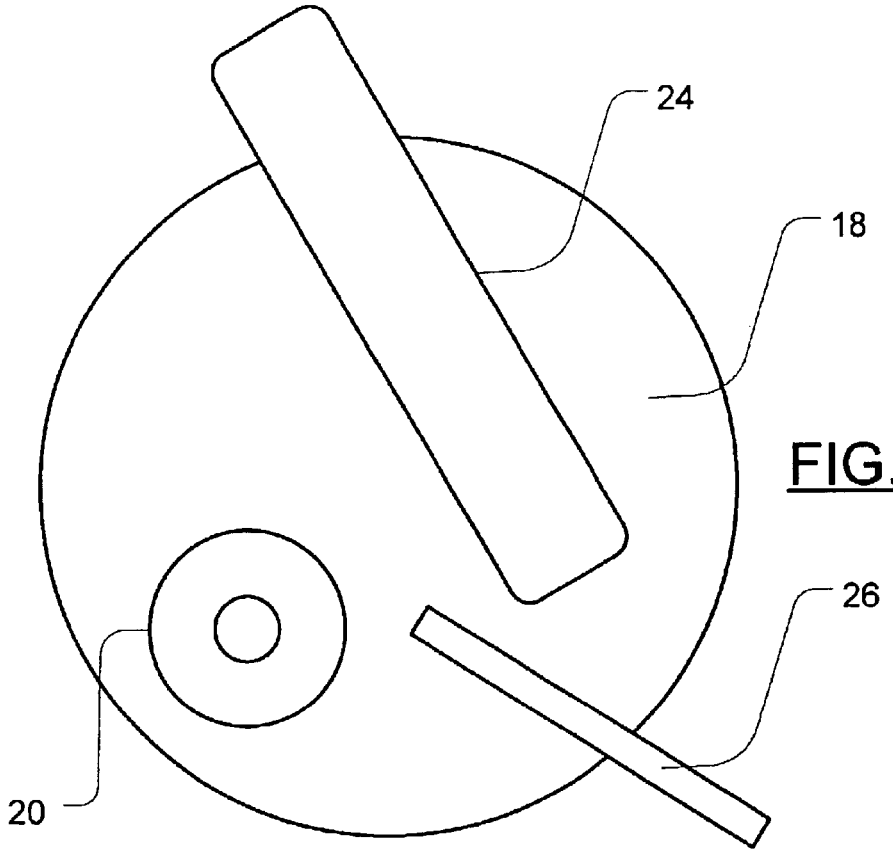
FIGS. 2A–B are a plan view and a side view of a planarization apparatus that may be used for planarizing substrates using planarizing pads incorporating a layer of a fixed abrasive material manufactured according to an exemplary embodiment of the invention.
Figure 2B:
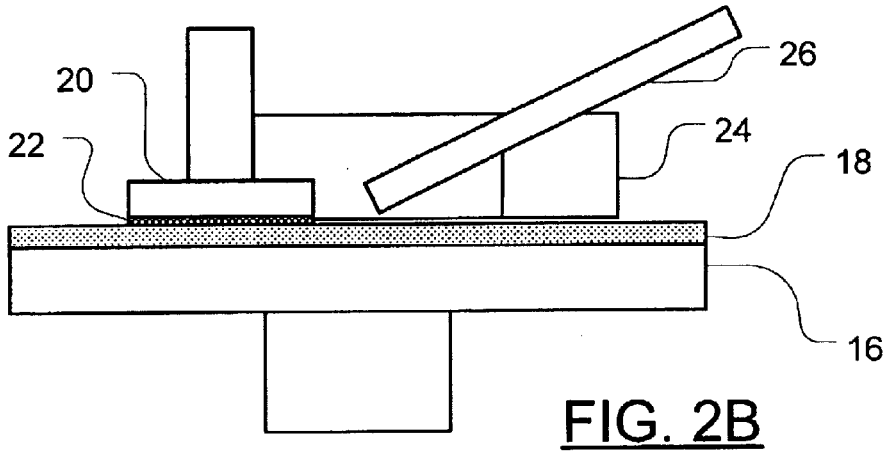

As illustrated in FIGS. 2A–B, a typical CMP apparatus for use with a fixed abrasive planarization pad will comprise at least a platen 16 supporting the planarizing pad 18, a wafer carrier 20 supporting a wafer 22 and positioning a major surface of the wafer adjacent a major surface of the planarizing pad 18, and a conditioning device 24 for conditioning the major surface of the planarizing pad and a carrier liquid supply line 26 for applying a carrier liquid to the major surface of the pad. The platen 16 and the wafer carrier 20 are configured to provide relative motion between the major surface of the planarizing pad 18 and the major surface of the wafer 22 while applying a force tending to move the wafer and the planarizing pad against each other.

Polishing Pads:

The fixed abrasive materials of the present invention have an open cell structure of a thermoset polymer matrix defining a plurality of interconnected cells and abrasive particles distributed generally uniformly throughout the polymer matrix. The fixed abrasive materials of the present invention are preferably manufactured from a polymeric composition comprising an aqueous dispersion or emulsion of one or more compositions such as polyurethanes, polyether polyols, polyester polyols, polyacrylate polyols and polystyrene/polyacrylate latexes. The polymeric composition may also include one or more additives including polymerization catalysts, chain extenders, including amines and diols, isocyanates, both aliphatic and aromatic, surfactants and viscosity modifiers. (As used herein, the words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.)

An exemplary embodiment of a polyurethane dispersion useful for manufacturing a fixed abrasive material according to the present invention includes water, abrasive particles and a polyurethane (and/or a mixture capable of forming a polyurethane). The polyurethane dispersion will generally also include one or more additives such as surfactants, that may act as frothing aids, wetting agents and/or foam stabilizers, and viscosity modifiers. Polyurethane-forming materials may include, for example, polyurethane prepolymers that retain some minor isocyanate reactivity for some period of time after being dispersed, but as referenced herein, a polyurethane prepolymer dispersion will have reacted substantially completely to form a polyurethane polymer dispersion. Also, the terms polyurethane prepolymer and polyurethane polymer may encompass other types of structures such as, for example, urea groups.

Polyurethane prepolymers may be prepared by reacting active hydrogen compounds with an isocyanate, typically with a stoichiometric excess of the isocyanate. The polyurethane prepolymers may exhibit isocyanate functionality in an amount from about 0.2 to 20%, may have a molecular weight in the range of from about 100 to about 10,000, and are typically in a substantially liquid state under the conditions of the dispersal.

The prepolymer formulations typically include a polyol component, e.g., active hydrogen containing compounds having at least two hydroxyl or amine groups. Exemplary polyols are generally known and are described in such publications as *High Polymers*, Vol. XVI, "Polyurethanes, Chemistry and Technology," Saunders and Frisch, Interscience Publishers, New York, Vol. I, pp. 32–42, 44–54 (1962) and Vol. II, pp. 5–6, 198–199 (1964); *Organic Polymer Chemistry*, K. J. Saunders, Chapman and Hall, London, pp. 323–325 (1973); and *Developments in Polyurethanes*, Vol. I, J. M. Burst, ed., Applied Science Publishers, pp. 1–76 (1978). Active hydrogen containing compounds that may be used in the prepolymer formulations also include, alone or in an admixture, polyols comprising: (a) alkylene oxide adducts of polyhydroxyalkanes; (b) alkylene oxide adducts of non-reducing sugars and sugar derivatives; (c) alkylene oxide adducts of phosphorus and polyphosphorus acids; and (d) alkylene oxide adducts of polyphenols. These types of polyols may be generally referred to herein as "base polyols."

Examples of useful alkylene oxide adducts of polyhydroxyalkanes include adducts of ethylene glycol, propylene glycol, 1,3-dihydroxypropane, 1,4-dihydroxybutane, and 1,6-dihydroxyhexane, glycerol, 1,2,4-trihydroxybutane, 1,2,6-dihydroxyhexane, 1,1,1-trimethylolethane, 1,1,1-trimethylolpropane, pentaerythritol, polycaprolactone, xylitol, arabitol, sorbitol, mannitol. Other useful alkylene oxide adducts of polyhydroxyalkanes include the propylene oxide adducts and ethylene oxide capped propylene oxide adducts of dihydroxy- and trihydroxyalkanes. Yet other useful alkylene oxide adducts include adducts of ethylene diamine, glycerin, piperazine, water, ammonia, 1,2,3,4-tetrahydroxy butane, fructose, sucrose. Also useful are poly(oxypropylene) glycols, triols, tetrols and hexols and any of these compounds capped with ethylene oxide including poly(oxypropyleneoxyethylene)polyols. If present, the oxyethylene content may comprise between about 40 and about 80 wt % of the total polyol. Ethylene oxide, when used, may be incorporated in any way along the polymer chain, for example, as internal blocks, terminal blocks, randomly distributed blocks or any combination thereof.

Polyester polyols may also be used in preparing a polyurethane dispersion. Polyester polyols are generally characterized by repeating ester units, which can be aromatic or aliphatic, and by the presence of terminal primary or secondary hydroxyl groups, although many polyesters terminating in at least two active hydrogen groups may be used. For example, the reaction product of the transesterification of glycols with poly(ethylene terephthalate) may be used to prepare polyurethane dispersions. Other components useful in preparing a polyurethane dispersion include polyols having acrylic groups or amine groups, acrylate prepolymers, acrylate dispersions and hybrid prepolymers.

Preferably at least 50 wt % of the active hydrogen compounds used in preparing the polyurethane or polyurethane prepolymer is one or more polyether polyols having molecular weights of from about 600 to 20,000, more preferably from about 1,000 to 10,000 and most preferably from about 3,000 to 8,000, that also exhibit a hydroxyl functionality of at least 2.2, preferably between about 2.2 to 5.0, more preferably from about 2.5 to 3.8 and most preferably from about 2.6 to 3.5. As used herein, hydroxyl functionality is defined as the average calculated functionality of all polyol initiators after adjustment for any known side reactions which may affect functionality during polyol production.

The polyisocyanate component of the polyurethane or prepolymer formulations may include one or more organic polyisocyanates, modified polyisocyanates, isocyanate based prepolymers, or mixtures thereof. The polyisocyanates may include aliphatic and cycloaliphatic isocyanates, but aromatic, and especially multifunctional aromatic isocyanates, such as 2,4- and 2,6-toluenediisocyanate and the corresponding isomeric mixtures; 4,4'-, 2,4'- and 2,2'- diphenyl-methanediisocyanate (MDI) and the corresponding isomeric mixtures; mixtures of 4,4'-, 2,4'- and 2,2'-diphenylmethanediisocyanates and polyphenyl polymethylene polyisocyanates (PMDI); and mixtures of PMDI and toluene diisocyanates are preferred. Most preferably, the polyisocyanate used to prepare the prepolymer formulation of the present invention is MDI, PMDI or a mixture thereof.

The polyurethane prepolymers may include a chain extender or crosslinker. A chain extender is used to build the molecular weight of the polyurethane prepolymer by reaction of the chain extender with the isocyanate functionality in the polyurethane prepolymer, i.e., "chain extend" the polyurethane prepolymer. Suitable chain extenders and crosslinkers typically comprise a low equivalent weight active hydrogen containing compound having two or more active hydrogen groups per molecule. Chain extenders typically include at least two active hydrogen groups and crosslinkers typically include at least three active hydrogen groups such as hydroxyl, mercaptyl, or amino groups. Amine chain extenders may be blocked, encapsulated, or otherwise rendered less reactive. Other materials, particularly water, may also extend chain length and, therefore, may also be used as chain extenders in the polyurethane prepolymer formulation.

Polyamines are preferred as chain extenders and/or crosslinkers, particularly amine terminated polyethers such as, for example, JEFFAMINE D-400 from Huntsman Chemical Company, aminoethyl piperazine, 2-methyl piperazine, 1,5-diamino-3-methyl-pentane, isophorone diamine, ethylene diamine, diethylene triamine, aminoethyl ethanolamine, triethylene tetraamine, triethylene pentaamine, ethanol amine, lysine in any of its stereoisomeric forms and salts thereof, hexane diamine, hydrazine and piperazine. The chain extender may be used as an aqueous solution and may be present in an amount sufficient to react with up to 100 percent of the isocyanate functionality present in the prepolymer, based on one equivalent of isocyanate reacting with one equivalent of chain extender. Water may act as a chain extender and react with some or all of the isocyanate functionality present. A catalyst may also be included to promote the reaction between a chain extender and an isocyanate and chain extenders having three or more active hydrogen groups may also concurrently function as crosslinkers.

Catalysts suitable for use in preparing the polyurethanes and polyurethane prepolymers utilized in the present invention include, for example, tertiary amines, organometallic compounds and mixtures thereof. For example, suitable catalysts include di-n-butyl tin bis(mercaptoacetic acid isooctyl ester), dimethyltin dilaurate, dibutyltin dilaurate, dibutyltin sulfide, stannous octoate, lead octoate, ferric acetylacetonate, bismuth carboxylates, triethylenediamine, N-methyl morpholine, and mixtures thereof. The addition of a catalyst may decrease the time necessary to cure the polyurethane prepolymer dispersion to a tack-free state and may utilize a quantity of catalyst from about 0.01 to about 5 parts per 100 parts by weight of the polyurethane prepolymer.

Surfactants useful in the dispersion may include cationic surfactants, anionic surfactants or non-ionic surfactants. Anionic surfactants include, for example, sulfonates, carboxylates, and phosphates, cationic surfactants include quaternary amines and non-ionic surfactants include block copolymers containing ethylene oxide, propylene oxide, butylene oxide, or a combination thereof and silicone surfactants. Surfactants useful herein include external surfactants, i.e., surfactants that do not chemically react with the polymer during dispersion preparation, such as salts of dodecyl benzene sulfonic acid, and lauryl sulfonic acid. Surfactants useful herein also include internal surfactants, that may chemically react with the polymer during dispersion preparation, such as 2,2-dimethylol propionic acid (DMPA) and its salts or sulfonated polyols neutralized with ammonium chloride. The surfactant or surfactants may be included in the polyurethane dispersion in an amount ranging from about 0.01 to about 20 parts per 100 parts by weight of polyurethane component. The selection and use of surfactant compositions in polyurethane dispersions is addressed in U.S. Pat. No. 6,271,276, the contents of which are incorporated herein, in their entirety, by reference.

A polyurethane dispersion having a mean particle size of less than about 5 microns may be generally considered to be shelf-stable or storage-stable while polyurethane dispersions having a mean particle size greater than about 5 microns will tend to be less stable. Polyurethane dispersions may be prepared by mixing a polyurethane prepolymer with water and dispersing the prepolymer in the water using a mixer. Alternatively, the polyurethane dispersion may be prepared by feeding a prepolymer and water into a static mixing device, and dispersing the water and prepolymer in the static mixer. Continuous methods for preparing aqueous dispersions of polyurethane are also known as disclosed in, for example, U.S. Pat. Nos. 4,857,565; 4,742,095; 4,879,322; 3,437,624; 5,037,864; 5,221,710; 4,237,264; 4,092,286 and 5,539,021, the contents of which are incorporated herein, in their entirety, by reference.

A polyurethane dispersion useful for forming a fixed abrasive pad will generally include polyurethane component, abrasive particles, and one or more surfactants to control the frothing and stabilize the resulting foam to produce a cured foam having a density between 350 $kg/m^3$ and 1200 $kg/m^3$ while maintaining desired foam properties like abrasion resistance, tensile, tear, and elongation (TTE), compression set, foam recovery, wet strength, toughness, and adhesion. As will be appreciated by those of ordinary skill in the art, because certain of these various properties are interrelated, modifying one property will tend to effect the values of one or more of the other properties. One skilled in the art, however, guided by this disclosure can produce a range of compositions having a combination of values acceptable for various purposes. Although the cured foam may have a density of between about 350 $kg/m^3$ and 1200 $kg/m^3$, preferred foams will have a density of about 600–1100 $kg/m^3$, more preferred foams will have a density of about 700–1000 $kg/m^3$ and most preferred foams will have a density of about 750–950 $kg/m^3$.

As noted above, surfactants may be useful in preparing the polyurethane dispersion and may also be useful in preparing a froth from the dispersion. Surfactants useful for preparing a froth are referred to herein as frothing surfactants and typically act by allowing the frothing agent, typically a gas and commonly air, used in the frothing process to disperse more homogenously and efficiently throughout the polyurethane dispersion. Frothing surfactants may be selected from a variety of anionic, cationic and zwitterionic surfactants and preferably, after curing, provide a non-sudsing foam. A commonly used anionic surfactant, sodium lauryl sulfate, for instance is less preferred because of a tendency to cause some post-cure sudsing in the final foam product.

Preferred frothing surfactants include carboxylic acid salts representedby the general formula:

$$RCO_2^-X^+ \quad (I),$$

where R represents a $C_8$–$C_{20}$ linear or branched alkyl, which may contain an aromatic, a cycloaliphatic, or heterocycle; and X is a counter ion, generally Na, K, or an amine, such as $NH_4^+$, morpholine, ethanolamine, or triethanolamine. Preferably R represents a $C_{10}$–$C_{18}$ linear or branched alkyl, and more preferably a $C_{12}$–$C_{18}$ linear or branched alkyl. The surfactant may include a number of different R species, such as a mixture of $C_8$–$C_{20}$ alkyl salts of fatty acids. Amines are preferred and ammonium salts, such as ammonium stearate, are more preferred as the counter ion, X, in the surfactants. The amount of frothing surfactant(s) used may be based on the dry solids content in the surfactant relative to polyurethane dispersion solids in parts per hundred. Generally, between about 1 and 20 parts of dry frothing surfactant may be used per 100 parts of polyurethane dispersion, although between 1 and 10 parts is preferred.

Surfactants may also be useful for stabilizing the polyurethane froth and are referred to herein generally as stabilizing surfactants. Stabilizing surfactants may be based on sulfonic acid salts, such as sulfates including alkylbenzenesulfonates, succinamates, and sulfosuccinamates. Preferred sulfates are sulfosuccinate esters that may be represented by the general formula:

$$R^2OOCCH_2CH(SO_3^-M^+)COOR^3 \quad \text{(II)},$$

where $R^2$ and $R^3$ each represent a $C_6$–$C_{20}$ linear or branched alkyl, which can contain an aromatic, a cycloaliphatic and where M represents is a counter ion, generally ammonia or an element from group 1A of the Periodic Table, such as lithium, potassium, or sodium. Preferably $R^2$ and $R^3$ each represent a different or identical $C_8$–$C_{20}$ linear or branched alkyl and, more preferably, a $C_{10}$–$C_{18}$ linear or branched alkyl. The surfactant may include a number of different $R^2$ and $R^3$ species, with amines being preferred and ammonium salts being more preferred. Salts of octadecyl sulfosuccinates are also preferred. Generally, between about 0.01 and 20 parts of dry stabilizing surfactant may be used per 100 parts of polyurethane dispersion, although between about 0.1 and 10 parts is preferred.

In addition to one or more of the anionic surfactants described above, the polyurethane dispersion may also include a zwitterionic surfactant to enhance frothing and/or stability of the froth. Suitable zwitterionic sufactants include N-alkylbetaines and beta-alkylproprionic acid derivatives. N-alkylbetaines may be represented by the general formulas:

$$R^4N^+(CH_3)_2CH_2COO^-M^+ \quad \text{(III)},$$

$$R^4N^+Cl^-M+ \text{ or} \quad \text{(IV)},$$

$$R^4N^+Br^-M^+ \quad \text{(V)},$$

where $R^4$ is a $C_6$–$C_{20}$ linear or branched alkyl, which can contain an aromatic, a cycloaliphatic and M are as described above. One or more zwitterionic surfactants may be included in the polyurethane dispersion at up to about 10 parts of dry zwitterionic surfactant per 100 parts of polyurethane dispersion, and preferably between about 0.05 to 4 parts of dry surfactant.

In addition to the surfactants specifically listed above, other surfactants may be included in the polyurethane dispersion in order to achieve the desired frothing and foam stability. In particular, additional anionic, zwitterionic or nonionic surfactants may be used in combination with the above listed surfactants.

The polyurethane dispersion also comprises one or more abrasive particulate compositions. Such abrasive compositions may be either a dry powder or an aqueous slurry to produce a final polyurethane dispersion composition comprising between about 1 and 80 wt %, and more preferably between about 20 and 70 wt %, of the abrasive particulates. The abrasive particulates may comprise one or more fine abrasive materials, typically one or more inorganic oxides selected from a group consisting of silica, ceria, alumina, zirconia and titania and have an average particle size of between about 10 nm and 1 μm, preferably no more than about 500–600 nm.

The polyurethane dispersion and/or the abrasive material may also include a wetting agent for improving the compatibility and dispersability of the abrasive particles throughout the polyurethane dispersion. Wetting agents may include phosphate salts such as sodium hexametaphosphate and may be present in the polyurethane dispersion at a concentration of up to 3 parts per 100 parts of polyurethane dispersion.

The polyurethane dispersion may also include viscosity modifiers, particularly thickeners, to adjust the viscosity of the polyurethane dispersion. Such viscosity modifiers include ACUSOL 810A (trade designation of Rohm & Haas Company), ALCOGUM™ VEP-II (trade designation of Alco Chemical Corporation) and PARAGUM™ 241 (trade designation of Para-Chem Southern, Inc.). Other suitable thickeners include cellulose ethers such as Methocel™ products (trade designation of The Dow Chemical Company). The viscosity modifiers may be present in the polyurethane dispersion in any amount necessary to achieve the desired viscosity, but are preferably present at less than 10 wt % and more preferably at less than 5 wt %. Unless otherwise indicated, all references to "weight percent" or "parts" are "dry" values, i.e., they do not reflect the water content of the component or dispersion.

The resulting polyurethane dispersion may have an organic solids content of up to about 60 wt %, an inorganic solids content, e.g., abrasive particles, of up to about 60 wt %, a viscosity of between about 500 and 50,000 cps, a pH of between about 4 and 11 and may include up to about 25 wt % surfactant(s). This polyurethane dispersion will also typically have an average organic particulate size of between about 10 nm and 50 μm, and preferably less than about 5 μm to improve its stability.

In order to produce a polyurethane foam from the polyurethane dispersion, the polyurethane dispersion is frothed, typically through the injection of one or more frothing agents, generally including one or more gases such as, for example, air, carbon dioxide, oxygen, nitrogen, argon and helium. The frothing agent(s) is typically introduced into the polyurethane dispersion by injecting the frothing agent, under pressure, into the polyurethane dispersion. A substantially homogeneous froth is then generated by applying mechanical shear forces to the polyurethane dispersion using a mechanical frother. In order to improve the homogeneity of the frothed composition, it is preferred that all components of the polyurethane dispersion, with the exception of the frothing agent, be mixed in a manner that does not incorporate excess quantities of gas into the dispersion prior to the frothing process. The mechanical frothing may be achieved with a variety of equipment, including frothers available from manufacturers including OAKES, COWIE & RIDING and FIRESTONE.

Once the polyurethane dispersion has been frothed, a layer of the frothed composition may be applied to a suitable substrate, such as a polycarbonate sheet or other polymeric material, using application equipment such as a doctor knife or roll, air knife, or doctor blade to apply and gauge the layer. See, for example, U.S. Pat. Nos. 5,460,873 and 5,948,500, the contents of which are hereby incorporated, in their entirety, by reference. The backing material or substrate may also be heated to a temperature between about 25 to 50° C. prior to the application of the frothed polyurethane dispersion.

After the frothed polyurethane dispersion is applied to the substrate, the froth is treated to remove substantially all of the water remaining in the froth and cure the polyurethane materials to form a resilient polyurethane foam having an open cell structure containing fine abrasive particles dispersed generally uniformly throughout the cell walls. The water is preferably removed at least partially by heating the froth and may use one or more energy sources such as an infrared oven, a conventional oven, microwave or heating plates capable of achieving temperatures of from about 50 to 200° C. The froth may also be cured by gradually increasing the temperature in a step-wise or continuous ramping manner. For example, curing a layer of the froth may comprise heating in three steps of approximately 30 minutes each at temperatures of about 70, 125 and 150° C. respectively.

The frothed polyurethane dispersion may be applied to the substrate to achieve a range of layer thicknesses and weights, ranging from about 1 kg/m$^2$ to about 14.4 kg/m$^2$ (about 3.3 oz/ft$^2$ to about 47.2 oz/ft$^2$) dry weight, depending on the characteristics of the substrate, the desired coating weight and the desired thickness. For example, for foams having a thickness between about 3 and 6 mm, the preferred coating weight is from about 2.1 kg/m$^2$ to about 5.7 kg/m$^2$ (about 6.9 oz/ft$^2$ to about 18.7 oz/ft$^2$) dry weight. For foams having a thickness of about 12 mm, the preferred coating weight is from about 9 kg/m$^2$ to about 11.4 kg/m (about 29.5 oz/ft$^2$ to about 37.4 oz/ft$^2$) dry weight.

Other types of aqueous polymer dispersions may be used in combination with the polyurethane dispersions described above including styrene-butadiene dispersions; styrene-butadiene-vinylidene chloride dispersions; styrene-alkyl acrylate dispersions; ethylene vinyl acetate dispersions; polychloropropylene latexes; polyethylene copolymer latexes; ethylene styrene copolymer latexes; polyvinyl chloride latexes; or acrylic dispersions, like compounds, and mixtures thereof. Other components useful in preparing suitable aqueous polymer dispersions include polyols having acrylic groups or amine groups, acrylate prepolymers, expoxies, acrylic dispersions, acrylate dispersions and hybrid prepolymers.

The polyurethane foams produced by curing the frothed polyurethane dispersions described above are typically resilient open cell foams, i.e., foams that exhibit a resiliency of at least 5% when tested according to ASTM D3574. The polyurethane foams preferably exhibit a resiliency of from about 5 to 80%, more preferably from about 10 to 60%, and most preferably from about 15 to 50%, and a foam density between about 0.35 and 1.2 grams/cm$^3$, preferably between about 0.7 and 1.0 grams/cm$^3$, and most preferably between about 0.75 and 0.95 grams/cm$^3$.

Figure 3A:
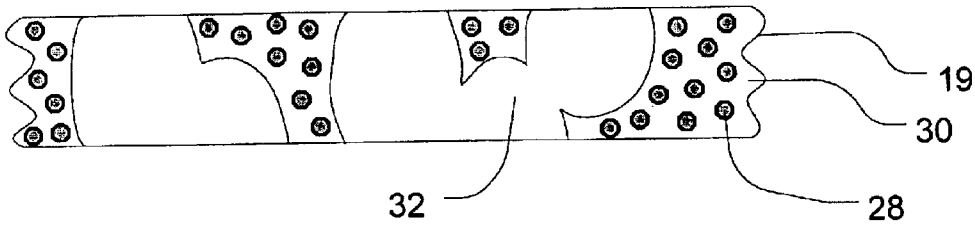
FIG. 3A is a cross-sectional view generally corresponding to a fixed abrasive composition according to an exemplary embodiment of the invention.

As illustrated in FIG. 3A, the fixed abrasive material 19 comprises a polymeric material 28 containing a substantially uniform distribution of abrasive particles 30. The polymeric material has an open cell structure in which small adjacent cells 32 are randomly connected to one another to provide paths for fluid flow from the surface of the fixed abrasive material into and through the bulk of the fixed abrasive material.

Figure 3B:
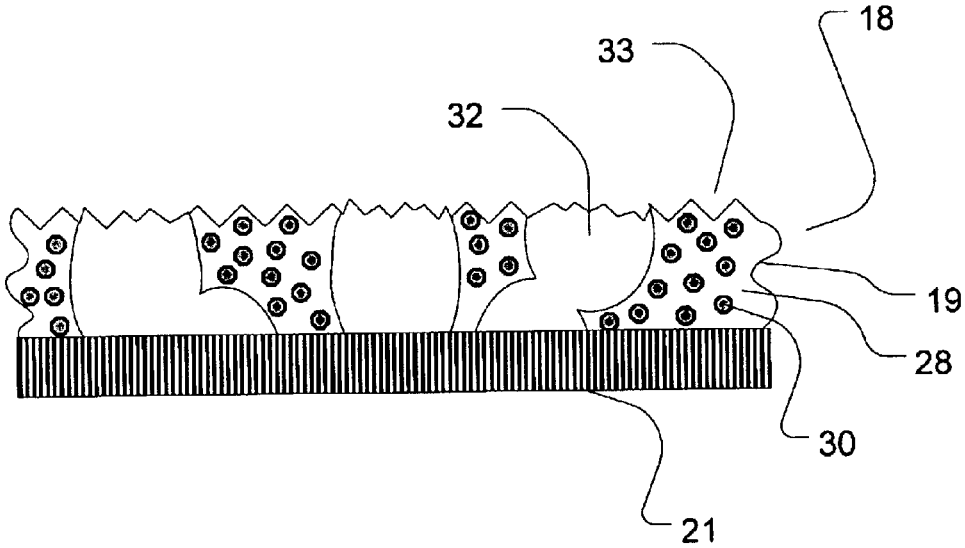
FIG. 3B is a cross-sectional view generally corresponding to a portion of a planarizing pad incorporating a layer of a fixed abrasive material according to an exemplary embodiment of the invention.

As illustrated in FIG. 3B, in a preferred embodiment, the fixed abrasive material 19 is provided as a layer on a substrate material 21 to form a fixed abrasive planarizing pad 18. In a preferred method, the material is conditioned to form nano-asperities 33 on the exposed major surface of the fixed abrasive material 19. The open cell construction of the fixed abrasive material 19 allows liquid and fine particles to flow into and through the fixed abrasive material and through the substrate material 21. (As will be appreciated, FIGS. 3A–B are intended only to illustrate a simplified embodiment of the fixed abrasive material and a planarizing pad structure utilizing the fixed abrasive material according to the present invention for purposes of discussion and are, consequently, not drawn to scale and should not, therefore, be considered to limit the invention.)

Figure 4A:
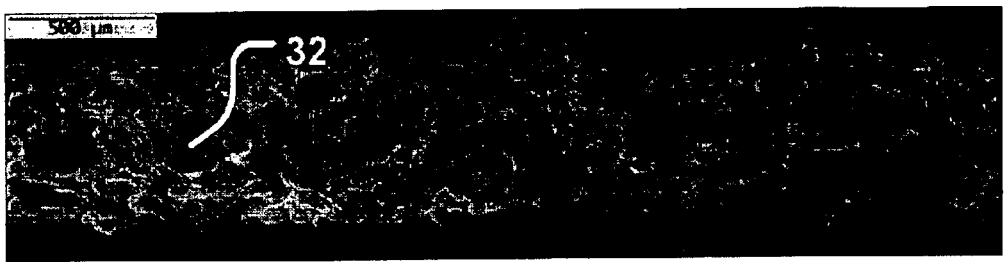
FIGS. 4A–B are SEM microphotographs of a fixed abrasive material manufactured according to an exemplary embodiment of the invention.
Figure 4B:
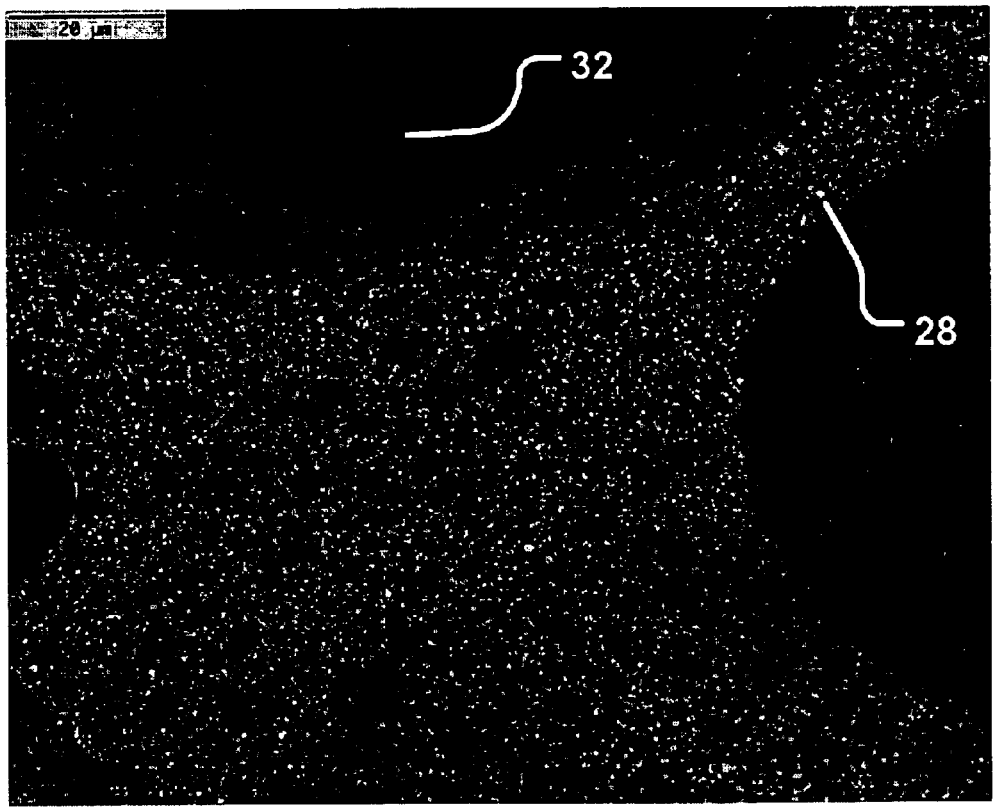
Figure 5A:
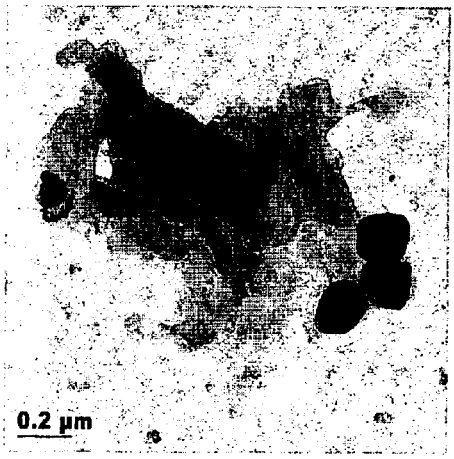
FIGS. 5A–D are SEM micrographs reflecting the range of particle composition produced by the conditioning of a layer of a fixed abrasive material according to an exemplary embodiment of the invention provided on the planarizing surface of a planarizing pad.
Figure 5B:
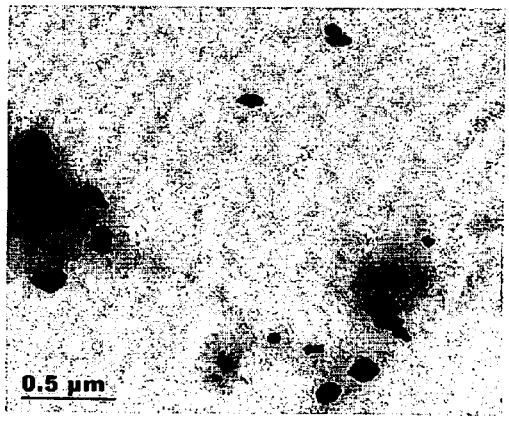
Figure 5C:
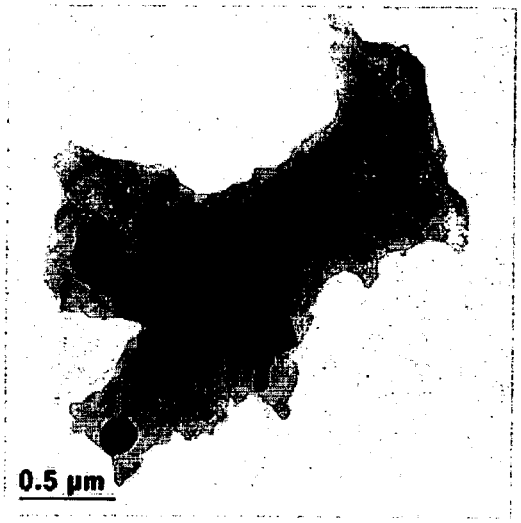
Figure 5D:
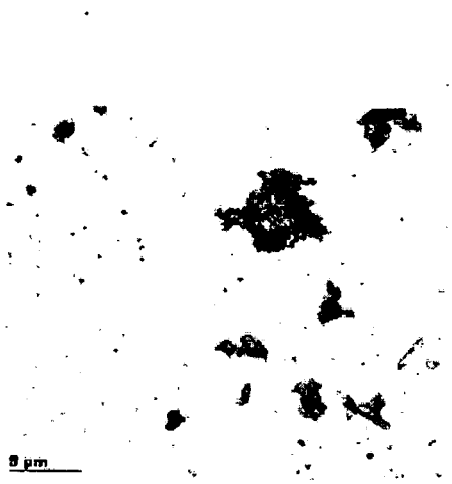

A fixed abrasive material manufactured according to the present invention was examined under a SEM to produce the micrographs provided as FIGS. 4A and 4B. FIG. 4A shows an exemplary embodiment of the fixed abrasive material under a relatively low magnification to illustrate the highly open structure. FIG. 4B shows a portion of the fixed abrasive material under much higher magnification to reveal details of the cell structure 32 and illustrate the uniform distribution of the abrasive particles, i.e., the bright specks 28, throughout the polymeric composition forming the cell walls.

The polymer matrix may have a density from about 0.5 to about 1.5 g/cm$^3$, preferably from about 0.7 to about 1.4 g/cm$^3$, more preferably from 0.9 and about 1.3 g/cm$^3$, and most preferably between about 1.1 and 1.25 g/cm$^3$. The polymer matrix may have a Shore A hardness of from about 30 and about 90, preferably from about 70 to about 85, and more preferably from about 75 and about 85. The polymer matrix may have a percent rebound at 5 psi of from about 30 to about 90, preferably from about 50 to about 80, and more preferably from about 50 and about 75. The polymer matrix may have a percent compressibility at 5 psi of from about 1 to about 10%, preferably from about 2 to about 6%, more preferably from about 2 to about 4%. The polymer matrix may have a porosity of between about 5 and 60%, preferably between about 10 and 50%, and more preferably, between about 20 and 40%. The polymer matrix may have a median cell size between about 5 and 500 μm, preferably between about 30 and 300 μm, and more preferably between about 30 and 200 μm.

Planarization or polishing pads manufactured from a fixed abrasive material according to the present invention may be used to removed one or more materials from a major surface of a semiconductor substrate in a process in which:

- a carrier liquid is applied to the polishing surface of a polishing pad, the polishing pad having an open cell structure of a thermoset polymer matrix defining a plurality of interconnected cells and abrasive particles distributed throughout the polymer matrix;
- causing relative motion between the substrate and the polishing surface of the polishing pad in a plane generally parallel to the major surface of the substrate while applying a force tending to bring the major surface and the polishing surface into contact;
- conditioning the polishing surface, thereby releasing abrasive particles from the polymer matrix to form free abrasive particles; and
- polishing the major surface of the substrate with the free abrasive particles to remove a portion of the material from the major surface of the substrate.

As reflected in the SEM micrographs in FIGS. 5A–D, the particles released by conditioning the polishing surface of a planarizing or polishing pad comprising a fixed abrasive material according to exemplary embodiments of the invention may include a mixture of free abrasive particles, polymer particles and composite particles including abrasive particles on the surface or still encompassed within a polymer particle. This mixture of particles acts to reduce the defectivity of the resulting polished surface.

The following exemplary examples are provided to illustrate the present invention. The examples are not intended to limit the scope of the present invention and should not be so interpreted. All weight percentages and parts are by dry weight unless otherwise noted.

EXAMPLE A1

An exemplary polyurethane, composition A1, was prepared by combining:

80 parts WITCOBOND A-100 (WITCO Corp.);

20 parts WITCOBOND W-240 (WITCO Corp.);

15 parts surfactant (consisting of 9 parts STANFAX 320, 3 parts STANFAX 590, and 3 parts STANFAX 318) (Para-Chem Southern Inc.);

8.5 parts ACUSOL 810A (as a viscosity modifier/thickener) (Rohm & Haas); and 100 parts 500 nm ceria particles to form an aqueous dispersion (all parts reflecting dry weight). The polyurethane dispersion was then allowed to stand for approximately one hour to stabilize the viscosity at about 9500 cps. The polyurethane dispersion was then frothed using an OAKES frother to produce a froth having a density of approximately 1040 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.95 grams/cm$^3$.

Although the Examples include viscosities between about 8000 and 10,000 cps, depending on the application, the viscosity of the frothed polyurethane dispersions could range between about 5000 and 15,000 or perhaps higher while still producing fixed abrasive materials incorporating the advantages of the present invention. Similarly, depending on the application, the density of the frothed polyurethane dispersions could be adjusted to provide either more or less dense froths that could range from about 500 grams per liter to about 1500 or more grams per liter.

EXAMPLE A2

Another exemplary polyurethane composition, composition A2, was prepared by combining:

60 parts WITCOBOND A-100;

40 parts WITCOBOND W-240;

15 parts surfactant (consisting of 9 parts STANFAX 320, 3 parts STANFAX 590, and 3 parts STANFAX 318);

8.5 parts ACUSOL 810A (as a viscosity modifier/thickener); and 70 parts 500 nm ceria particles to form an aqueous dispersion. The polyurethane dispersion was then allowed to stand for approximately one hour to stabilize the viscosity at about 10,000 cps. The polyurethane dispersion was then frothed using an OAKES frother to produce a froth having a density of approximately 970 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.95 grams/cm$^3$.

EXAMPLE A3

Another exemplary polyurethane composition, composition A3, was prepared by combining:

20 parts WITCOBOND A-100;

80 parts WITCOBOND W-240;

15 parts surfactant (consisting of 9 parts STANFAX 320, 3 parts STANFAX 590, and 3 parts STANFAX 318);

8.5 parts ACUSOL 810A (as a viscosity modifier/thickener); and 70 parts 500 nm ceria particles to form an aqueous dispersion. The polyurethane dispersion was then allowed to stand for approximately one hour to stabilize the viscosity at about 10,000 cps. The polyurethane dispersion was then frothed using an OAKES frother to produce a froth having a density of approximately 970 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.95 grams/cm$^3$.

EXAMPLE B1

Another exemplary polyurethane composition, composition B 1, was prepared by combining:

40 parts WITCOBOND A-100;

60 parts WITCOBOND W-240;

15 parts surfactant (consisting of 9 parts STANFAX 320, 3 parts STANFAX 590, and 3 parts STANFAX 318);

8.5 parts ACUSOL 810A (as a viscosity modifier/thickener); and 50 parts 500 nm ceria particles to form an aqueous dispersion. The polyurethane dispersion was then allowed to stand for approximately one hour to stabilize the viscosity at about 9660 cps. The polyurethane dispersion was then frothed using an OAKES frother to produce a froth having a density of approximately 997 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.95 grams/cm$^3$.

EXAMPLE B2

Another exemplary polyurethane composition, composition B2, was prepared by combining:

A preferred prepolymer composition may be prepared by combining:

80 parts WITCOBOND A-100;

20 parts WITCOBOND W-240;

15 parts surfactant (consisting of 9 parts STANFAX 320, 3 parts STANFAX 590, and 3 parts STANFAX 318);

8.5 parts ACUSOL 810A (as a viscosity modifier/thickener); and 100 parts 1 μm ceria particles to form an aqueous dispersion. The polyurethane dispersion was then allowed to stand for approximately one hour to stabilize the viscosity at about 8270 cps. The polyurethane dispersion was then frothed using an OAKES frother to produce a froth having a density of approximately 943 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a density between about 0.75 and 0.95 grams/cm$^3$.

With regard to the specific components identified above WITCOBOND A-100 is an aqueous dispersion of an aliphatic urethane/acrylic alloy, WITCOBOND W-240 is an aqueous dispersion of an aliphatic urethane, ACUSOL 810A is an anionic acrylic copolymer, STANFAX 318 is an anionic surfactant comprising sodium sulfosuccinimate used as a foam stabilizer, STANFAX 320 is an anionic surfactant comprising ammonium stearate used as a foaming agent, and STANFAX 519 is a surfactant comprising a di-(2-ethylhexyl) sulfosuccinate sodium salt used as a wetting/penetrant agent.

Samples of the fixed abrasive materials corresponding to Examples A1 and B 1 were subjected to additional testing as reflected below in Table 1.

TABLE 1

| Parameter | Example A1 | Example B1 |
|---|---|---|
| Shore A Hardness | 78.2–84.4 | 79.1–88.6 |
| % Compressibility at 5 psi | 2.03–3.63 | 2.00–4.09 |
| % Rebound at 5 psi | 45.0–77.0 | 53.9–76.0 |
| Density (grams/cm$^3$) | 0.79 | 0.76 |

Additional characterization tests were conducted using samples of the fixed abrasive compositions produced according to Examples A1, A2, B1 and B2 including a mercury porosimetry analysis. The mercury porosimetry analysis was performed on a Micromeritics Autopore IV 9520. Prior to the analysis, the samples were out-gassed at room temperature under a vacuum to remove the majority of any physiosorbed species from the surface of the materials and then cut into rectangles (approximately 15 mm×25 mm) to help provide a substantially constant area basis and producing samples of approximately 0.43–0.49 g.

The test conditions included a Hg fill pressure of 0.41 psia, a Hg contact angle of 130.0°, a Hg surface tension of 485.0 dyn/cm, a Hg density of 13.53 g/mL, a 5 minute evacuation time, small bore penetrometer (solid type) with a 5-cc bulb, a 30 second equilibration time, 92-point pressure table (75 intrusion+17 extrusion pressure points) with mechanical evacuation to less than 50 μm Hg. The pressure table used was adapted to provide an even incremental distribution of pressures on a log scale from 0.5 to 60,000 psia.

During the test Hg is forced into smaller and smaller pores as the pressure is increased incrementally from the initial vacuum to a maximum of nearly 60,000 psia. Hg porosimetry data including total intrusion volume, median pore diameter (volume), and bulk density is achieved with a precision of <3% RSD (relative standard deviation) for this instrument.

The initial unadjusted results for the Hg porosimetry data representing pore sizes between 0.003 and 400 μm diameter (calculated pressure range of 0.5–60,000 psia) are summarized in Table 2.

TABLE 2

| Sample | Median Pore Dia. (Vol.) μm | Bulk Density g/ml | Apparent (Skeletal) Density g/ml | Porosity, % |
|---|---|---|---|---|
| A1 | 94.5036 | 0.8687 | 1.3765 | 36.8895 |
| A2 | 44.9445 | 0.9774 | 1.3566 | 27.9543 |
| B1 | 94.2876 | 0.8481 | 1.3354 | 36.4905 |
| B2 | 54.9848 | 0.9462 | 1.3312 | 28.9205 |

Hg porosimetry is a bulk analysis of the overall porosity, and interstitial (void) filling (apparent porosity) may be created while the Hg is pushing its way between the pieces or particles of sample at low fill pressures. Typically, this is only a problem with small meshed or powdered materials and doesn't seem to be occurring for these samples.

However, because the samples are polyurethane/polycarbonate materials, it was expected that there would be some apparent intrusion during the Hg porosimetry measurements as a result of sample compression (Hg filling due to compression of the polymer with increasing Hg fill pressures). Because of this, the intraparticle pore volume (actual pore filling resulting from macropores) must be subtracted from the apparent pore volume (apparent pore filling resulting from sample compression) to determine the actual pore volume. Performing this adjustment produced the data summarized in Table 3 representing pore sizes between 5 and 400 μm diameter (for a calculated pressure range of 0.5–35 psia).

TABLE 3

| Sample | Median Pore Dia. (Vol.), μm | Bulk Density g/ml | Apparent (Skeletal) Density, g/ml | Porosity, % |
|---|---|---|---|---|
| A1 | 98.4307 | 0.8687 | 1.2925 | 32.7868 |
| A2 | 49.5243 | 0.9774 | 1.2738 | 23.2691 |
| B1 | 102.0095 | 0.8481 | 1.2562 | 32.4893 |
| B2 | 58.1107 | 0.9462 | 1.2521 | 24.4332 |

Figure 6:
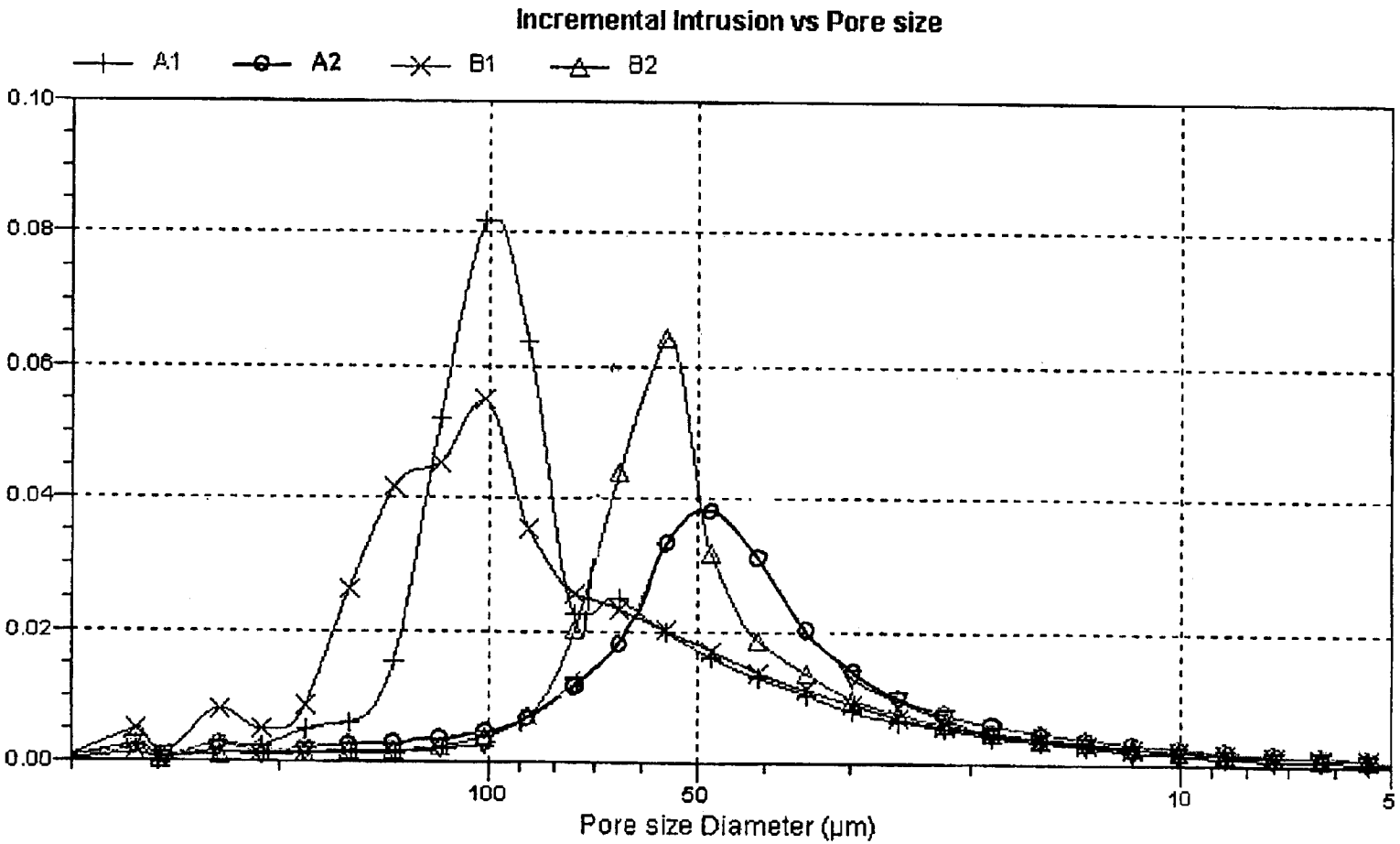
FIG. 6 is a graph illustrating the measured pore size distribution for a fixed abrasive material manufactured according to an exemplary embodiment of the invention.

The accuracy of the adjusted data was confirmed by comparing the sample total pore area (determined using Hg porosimetry) with its measured B.E.T. (Bruner, Emmett, and Teller) surface area (determined by krypton adsorption) of <0.05 m$^2$/g. The pore size distribution data for the tested samples is reflected in the graph illustrated in FIG. 6.

The principles and modes of operation of this invention have been described above with reference to certain exemplary and preferred embodiments. However, it should be noted that this invention may be practiced in manners other than those specifically illustrated and described above without departing from the scope of the invention as defined in the following claims.

We claim:

1. A method of forming a fixed abrasive material comprising:

forming an aqueous dispersion, the aqueous dispersion including at least one of a polymer and a polymer forming mixture, abrasive particles, and a surfactant;

injecting a frothing agent into the aqueous dispersion;

mechanically frothing the aqueous dispersion and the frothing agent to form a substantially uniform froth;

curing the froth to form an open cell foam having interconnected cells and a polymer matrix wherein the abrasive particles are distributed substantially uniformly throughout the polymer matrix.

2. A method of forming a fixed abrasive material according to claim 1, wherein:

the cells have a median cell diameter, the median cell diameter being less than about 300 μm.

3. A method of forming a fixed abrasive material according to claim 1, wherein:

the abrasive particles have an average particle size of less than about 2 μm.

4. A method of forming a fixed abrasive material according to claim 3, wherein:

the abrasive particles include at least one particulate material selected from a group consisting of alumina, ceria, silica, titania and zirconia.

5. A method of forming a fixed abrasive material according to claim 4, wherein:

the abrasive particles constitute between about 20 weight percent and about 70 weight percent of the polymer matrix;

the froth has a viscosity between about 5,000 and 15,000 cps and a density of between about 500 and 1500 grams per liter; and the open cell foam has a porosity of between about 20 and 40 percent and a median pore diameter of less than about 200 μm.

6. A method of forming a fixed abrasive material according to claim 1, wherein:

the polymer matrix includes a polyurethane.

7. A method of forming a fixed abrasive material according to claim 1, wherein:

the surfactant includes at least a frothing surfactant and a foam stabilizing surfactant.

8. A method of forming a fixed abrasive material according to claim 1, wherein:

the aqueous dispersion further includes a viscosity modifier.

9. A method of forming a fixed abrasive material according to claim 1, wherein:

the aqueous dispersion has an organic content of less than about 60 weight percent;

an inorganic content of less than about 60 weight percent; and a surfactant content of between about 1 and 20 weight percent.

10. A method of forming a fixed abrasive material according to claim 9, further wherein:

the aqueous dispersion has a viscosity modifier content of between about 1 and 10 weight percent.

11. A method of forming a fixed abrasive material according to claim 10, wherein:

the surfactant includes a mixture of a sodium sulfosuccinimate, an ammonium stearate, and a sulfosuccinate sodium salt.

12. A method of forming a fixed abrasive material according to claim 11, wherein:

the sodium sulfosuccinimate is present in an amount between about 1 and 6 parts, the ammonium stearate is present in an amount between about 3 and 15 parts, and the sulfosuccinate sodium salt is present in an amount between about 1 and 6 parts.

13. A method of forming a fixed abrasive material according to claim 12, wherein:

the sodium sulfosuccinimate, the ammonium stearate, and the sulfosuccinate sodium salt are present in a ratio of about 1:3:1.

14. A method of forming a fixed abrasive polishing pad comprising:

forming an aqueous dispersion, the aqueous dispersion including at least one of a polymer and a polymer forming mixture, abrasive particles, the abrasive particles having an average particle size of less than about 2 μm, and a surfactant;

injecting a frothing agent into the aqueous dispersion;

mechanically frothing the aqueous dispersion and the frothing agent to form a substantially uniform froth;

applying a layer of the froth to a substrate material;

curing the layer of the forth to form a layer of open cell foam comprising interconnected cells and a polymer matrix wherein the abrasive particles are distributed substantially uniformly throughout the polymer matrix.

15. A method of forming a fixed abrasive polishing pad according to claim 14, wherein:

the aqueous dispersion includes at least an alloyed aliphatic polyester based urethane and a polyacrylate as a first component and a self-crosslinking aliphatic urethane as a second component.

16. A method of forming a fixed abrasive polishing pad according to claim 15, wherein:

the first and second components are present in the aqueous dispersion in a weight ratio of between about 4:1 and 1:4.

17. A method of forming a fixed abrasive polishing pad according to claim 14, wherein:

the abrasive particles constitute one or more particulate materials selected from a group consisting of alumina, ceria, silica, titania and zirconia.

18. A method of forming a fixed abrasive polishing pad according to claim 17, wherein:

the abrasive particles constitute between about 20 weight percent and about 70 weight percent of the polymer matrix.

19. A method of forming a fixed abrasive polishing pad according to claim 14, wherein:

the surfactant includes at least a frothing surfactant and a foam stabilizing surfactant.

20. A method of forming a fixed abrasive polishing pad according to claim 19, wherein:

the aqueous dispersion further includes a viscosity modifier.

21. A method of forming a fixed abrasive polishing pad according to claim 14, wherein:

the aqueous dispersion has an organic content of less than about 60 weight percent;

an inorganic content of less than about 60 weight percent; and a surfactant content of between about 1 and 20 weight percent.

22. A method of forming a fixed abrasive polishing pad according to claim 21, further wherein:

the aqueous dispersion has a viscosity modifier content of between about 1 and 10 weight percent.

23. A method of forming a fixed abrasive polishing pad according to claim 22, wherein:

the surfactant includes a mixture of
a sodium sulfosuccinimate,
an ammonium stearate, and
a sulfosuccinate sodium salt.

24. A method of forming a fixed abrasive polishing pad according to claim 23, wherein:

the sodium sulfosuccinimate is present in an amount between about 1 and 6 parts, the ammonium stearate is present in an amount between about 3 and 15 parts, and the sulfosuccinate sodium salt is present in an amount between about 1 and 6 parts.

25. A method of forming a fixed abrasive polishing pad according to claim 24, wherein:

the sodium sulfosuccinimate, the ammonium stearate, and the sulfosuccinate sodium salt are present in a ratio of about 1:3:1.

26. A method of forming a fixed abrasive polishing pad according to claim 25, wherein:

the abrasive particles constitute between about 20 weight percent and about 70 weight percent of the polymer matrix;

the froth has a viscosity between about 5,000 and 15,000 cps and a density of between about 500 and 1500 grams per liter; and the open cell foam has a porosity of between about 20 and 40 percent and a median pore diameter of less than about 200 μm.

* * * * *